US005786829A

United States Patent [19]

Pasciak, Jr. et al.

[11] Patent Number: 5,786,829

[45] Date of Patent: Jul. 28, 1998

[54] APPARATUS AND METHOD FOR CLEANING AN INK FLOW PATH OF AN INK JET PRINTHEAD

[75] Inventors: Donald J. Pasciak, Jr., Farmington; Mark E. Klino, Macedon, both of N.Y.

[73] Assignee: Xerox Corporation, Stamford, Conn.

[21] Appl. No.: 673,479

[22] Filed: Jul. 1, 1996

[51] Int. Cl.[6] ..... B41J 2/165

[52] U.S. Cl. ..... 347/28; 347/25; 347/30

[58] Field of Search ..... 347/25, 28, 30, 347/84, 85, 43; 251/129.15, 129.21; 137/625.44; 400/701, 702, 702.1

[56] References Cited

U.S. PATENT DOCUMENTS

| | | | |
|---|---|---|---|
| 4,571,599 | 2/1986 | Rezanka | 347/87 |
| 4,849,769 | 7/1989 | Dressler | 347/22 |
| 4,849,774 | 7/1989 | Endo | 347/56 |
| 5,160,945 | 11/1992 | Drake | 347/42 |
| 5,210,550 | 5/1993 | Fisher et al. | 347/30 |
| 5,257,044 | 10/1993 | Carlotta et al. | 347/32 |
| 5,289,212 | 2/1994 | Carlotta | 347/87 |
| 5,574,485 | 11/1996 | Anderson et al. | 347/27 |

FOREIGN PATENT DOCUMENTS

| | | | |
|---|---|---|---|
| WO 93/17867 | 9/1993 | WIPO | B41J 2/165 |

OTHER PUBLICATIONS

Mitchell et al. "Start–Stop Technique for Ink Jet Systems", IBM Technical Disclosure Bulletin, vol. 20 No. 1, Jun. 1977.

*Primary Examiner*—N. Le
*Assistant Examiner*—Thien Tran

[57] ABSTRACT

A method and apparatus is provided for cleaning an ink jet printhead following a print operation. A housing assembly which includes the printhead is clamped into a fixed position, and a vacuum source is applied to the printhead nozzle face via a resilient sealing cap member. The printhead manifold is connected to a cleaning assembly which circulates a cleaning mixture comprising a cleaning liquid, such as water, and a gas, such as nitrogen, into the printhead manifold. This water and gas mixture is forced through the interior channels of the printhead and out the nozzles carrying ink and particulate matter into a waste receptacle. The flushing procedure continues until all ink is removed from the printhead. The cleaning operation is completely automated resulting in an effective and thorough cleaning operation. Optionally, a second vacuum is brought into close contact with the printhead nozzle face following the cleansing step to remove residual ink from the nozzle face.

9 Claims, 4 Drawing Sheets

APPARATUS AND METHOD FOR CLEANING AN INK FLOW PATH OF AN INK JET PRINTHEAD

BACKGROUND OF THE INVENTION AND MATERIAL DISCLOSURE STATEMENT

The present invention relates to a method and apparatus for cleaning an ink jet printhead following a print operation. More particularly, the invention relates to a procedure wherein ink in the printhead channels and nozzles are flushed out by a cleaning medium circulated under pressure through the printhead.

An ink jet printer of the so-called "drop-on-demand" type has at least one printhead from which droplets of ink are directed towards a recording medium. Within the printhead, the ink may be contained in a plurality of channels and energy pulses are used to cause the droplets of ink to be expelled, as required, from orifices at the ends of the channels.

In a thermal ink jet printer, the energy pulses are usually produced by resistors, each located in a respective one of the channels, which are individually addressable by current pulses to heat and vaporize ink in the channels. As voltage is applied across a selected resistor, a vapor bubble grows in that particular channel and ink bulges from the channel orifice. At that stage, the bubble begins to collapse. The ink within the channel retracts and separates from the bulging ink which forms a droplet moving in a direction away from the channel orifice and towards the recording medium. The channel is then re-filled by capillary action, which in turn draws ink from a supply container. Operation of a thermal ink jet printer is described in, for example, U.S. Pat. No. 4,849,774.

Commercial ink jet printers utilize a print cartridge comprising a printhead connected to an ink source via a manifold. The ink source is typically an ink bag or an ink tank or cartridge. At various times, it is desirable to clean the printhead following a print operation. It is known in the art to clean and reprime a printhead following a period of print operation. Typically, the printhead is mounted on a carriage which is periodically moved to a maintenance station where a cleaning mechanism engages the printhead to clean the printhead face and reprime the printhead.

U.S. Pat. No. 4,849,769 describes an ultrasonic cleaning method for removing particles from a printhead orifice plate. U.S. Pat. No. 5,210,550 discloses a maintenance station which primes a printhead and periodically stores the printhead in a humid environment.

For some usages, it may be necessary to periodically provide a more thorough cleaning of the printhead including removal of ink from interior ink pathways (channels) and nozzles as well as the ink manifold. This thorough cleaning becomes a positive requirement when a printhead, following manufacture, is initially tested prior to shipping to a remote site. The printhead must be thoroughly cleaned following the print test and prior to shipping so as to remove ink that is still within the interior passageways and nozzles and any other particulate matter which could affect ink ejection and performance. From the above comments, it is necessary to clean a printhead outside of the conventional maintenance station. Known procedures are to manually introduce a flushing medium into the printhead manifold and flush the ink out through the nozzles. This method is not completely effective and still leaves some residue of ink within the printhead.

SUMMARY OF THE INVENTION

It is an object of the invention to improve the cleaning of a printhead following a print usage.

It is a further object to cleaning the printhead by using an automated cleaning system.

These, and other objects, are obtained by placing the printhead into a fixed cleaning location and initiating an automated operation which includes applying a vacuum to the nozzle face of the printhead while simultaneously introducing a cleaning fluid into the printhead interior via the printhead manifold. In a preferred embodiment, the cleaning fluid comprises a mixture of water and nitrogen. The flushing action of the water and nitrogen mixture provides a very effective cleaning of the interior ink path of the printhead including the nozzle orifices. Optionally, a second vacuum source is moved into close proximity to the nozzle face of the printhead following the cleaning step to suction off any residual ink from the nozzle face. The printhead is then dried.

More particularly, the present invention relates to a method for cleaning the interior ink channels and nozzles of an ink jet printhead, comprising the steps of:

applying a vacuum to the printhead nozzles and flushing the interior ink channels and nozzles with a cleaning liquid and gas mixture.

The invention also relates to an automated cleaning fixture for cleaning the ink paths associated with an ink jet printhead including printhead nozzles, ink channels and manifold passageway connecting the printhead to an ink supply, the fixture including:

means for maintaining the printhead in a fixed position, a vacuum cap assembly, means for moving the vacuum cap assembly into sealing engagement with the printhead nozzles, a liquid cleaning assembly and means for moving the liquid cleaning assembly into communication with the printhead manifold to establish a passageway for circulating a liquid water/gas cleaning mixture from said cleaning assembly through said manifold, ink channels and nozzle into a waste repository whereby the passage of said water/gas mixture through the printhead removes residual ink and particulate matter from the printhead.

DESCRIPTION OF THE INVENTION

The principles of the present invention apply to the cleaning of various types of printheads supplied with ink from a variety of sources. The generic structure of the printhead to be cleaned includes a manifold member which fluidly feeds ink from an ink source into the interior channels of the printhead. The ink is expelled through nozzles upon application of heat to a resistor in the channel (for thermal ink jet printing) or application of a voltage across a transducer to construct the ink filled channels causing the ink ejection (piezoelectric ink jet printing). The ink source can be an ink bag, a solid housing (cartridge) filled with ink or with an ink impregnated foam. With either type of source, an ink exit port is fluidly and sealingly connected to the ink manifold of the printhead and, thence, into the interior ink pathways of the printhead.

Figure 1:
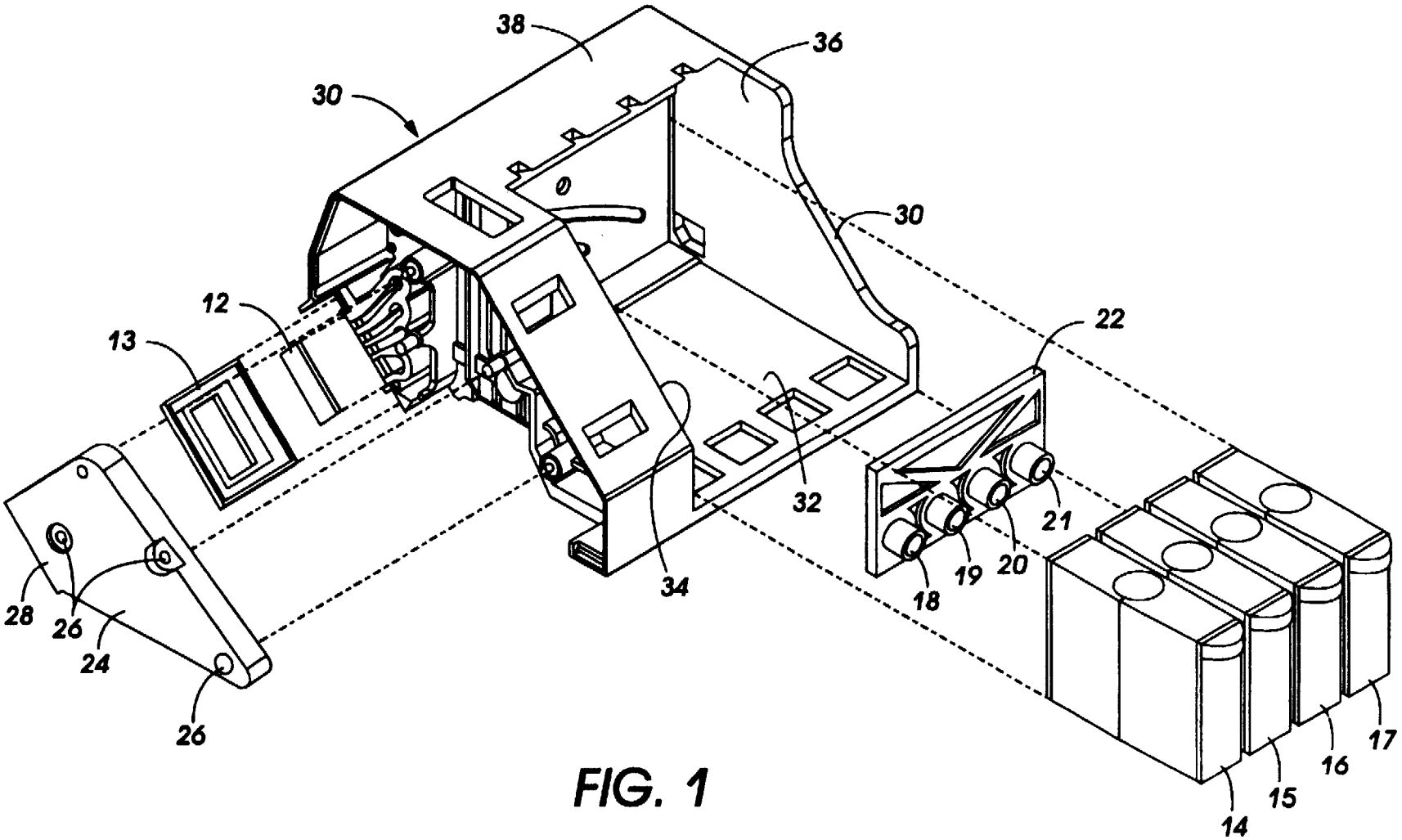
FIG. 1 is a partially exploded view of an exemplary printhead cartridge assembly cleaned by the present invention.

FIG. 1 shows a color printhead assembly of the type wherein ink is supplied from an ink-filled foam contained within a plurality of ink cartridges.

Specifically, color printhead assembly 10 comprises a segmented printhead 12 which has four segments, or groups, of nozzles (not visible), each group associated with printing ink of a different color onto a recording medium. The printhead segments are fabricated by methods known in the art and disclosed, for example, in U.S. Pat. No. 4,638 337, whose contents are hereby incorporated by reference. As described therein, printhead 12 is formed by bonding together a channel plate to a heater plate forming interior channels, each channel in thermal communication with a resistor element. Nozzles are formed on the front face of the printhead and overlain with a nozzle plate 13. Ink from ink cartridges 14, 15, 16, 17 is supplied via ink pipes 18, 19, 20, 21, respectively, of manifold 22 to the associated segments of printhead 12. The ink is filtered and sealed from leakage by internal seals and filters not visible. Upon selective pulsing of the resistive elements in the channels, ink in the channels is heated and expelled through the nozzles of the particular recording printhead segment.

To complete the description of assembly 10, the printhead is bonded to heat sink 24 which has three holes 26 formed in surface 28 for purposes to be discussed later. The heat sink and manifold are mounted on a housing frame 30 which has a floor 32 which seats the manifold and the ink cartridges. The housing also has side walls 34, 36 and a partial roof 38. The printhead 12 and housing frame 30, minus the cartridges will be referred to as printhead housing assembly.

The ink cartridges 14–17 are shown removed from the frame 30. For purposes of description, it is assumed that the cartridge had been installed during a print/test mode and been successfully tested and the cartridges have been partially or completely exhausted of ink.

The printhead assembly 10 is to be packed and shipped to a location where it will be installed in a printer with new cartridges. It is, therefore, necessary at this point to thoroughly clean the printhead, the manifold and the internal ink paths connecting the manifold to the printhead nozzles.

Figure 2:
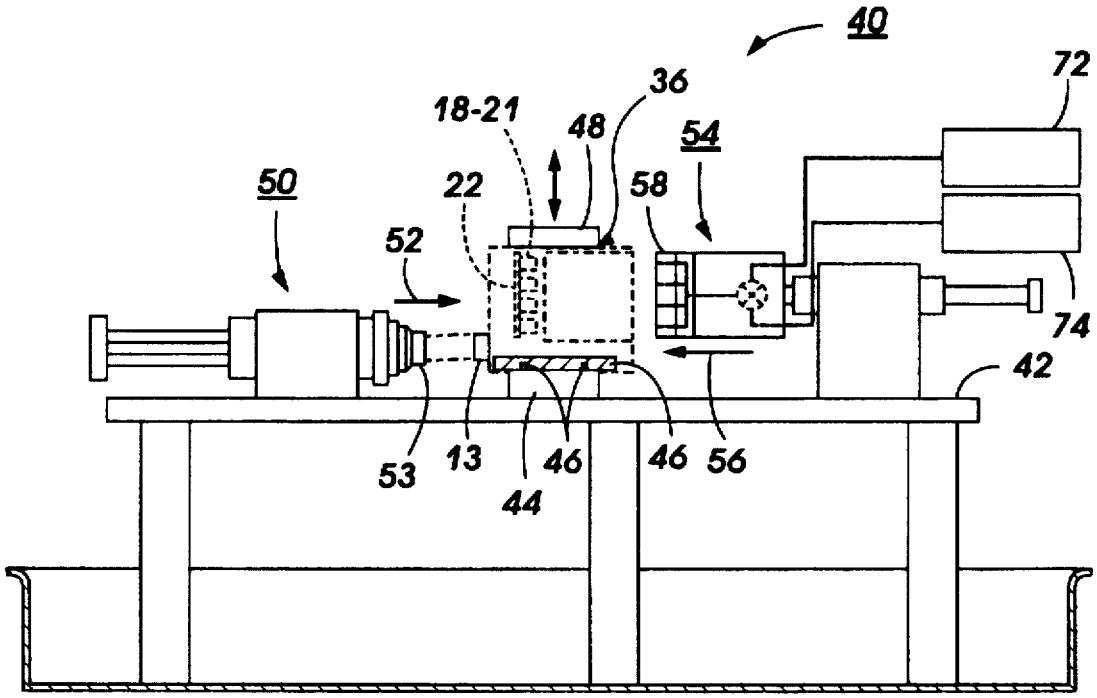
FIG. 2 is a side view of the assembly of FIG. 1, without the ink tanks, placed in a cleaning position in an automated cleaning system.
Figure 3:
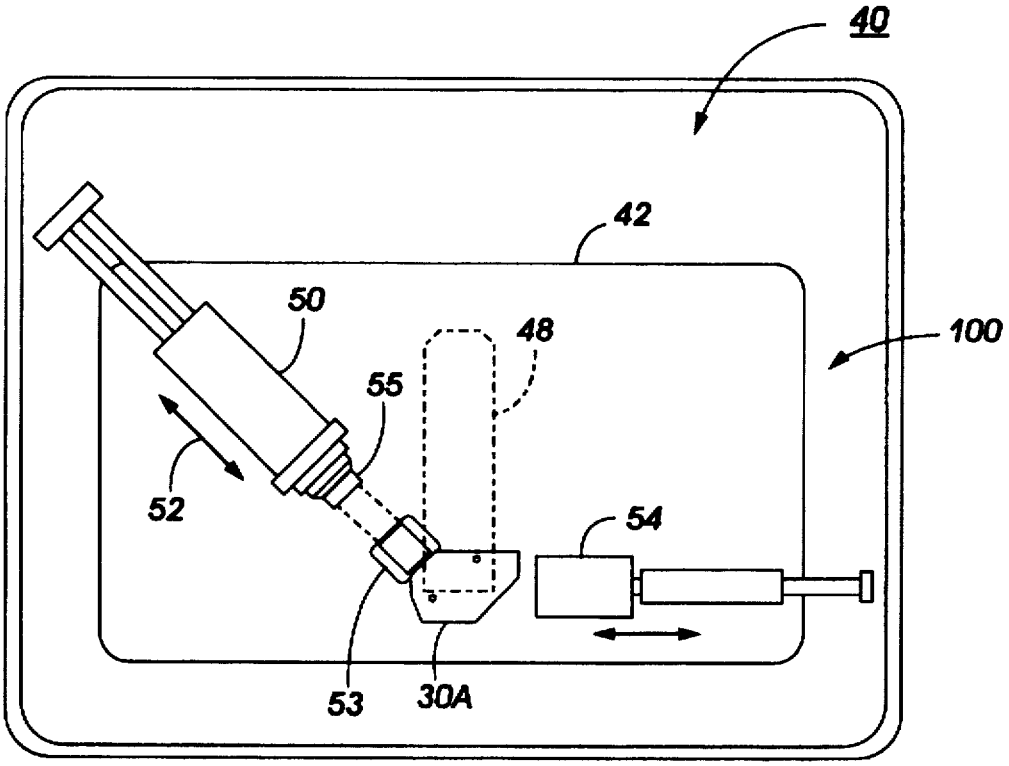
FIG. 3 is a top view of the cleaning system of FIG. 2.

According to the invention, the printhead housing assembly 30A (printhead assembly 10 minus the cartridges) is placed in an automated cleaning fixture shown in side view in FIG. 2 and in top view in FIG. 3. A liquid cleaning mixture is injected into manifold 22, passes through the internal ink paths and is withdrawn through the nozzles by application of a vacuum applied across the printhead nozzle plate 13.

Figure 4:
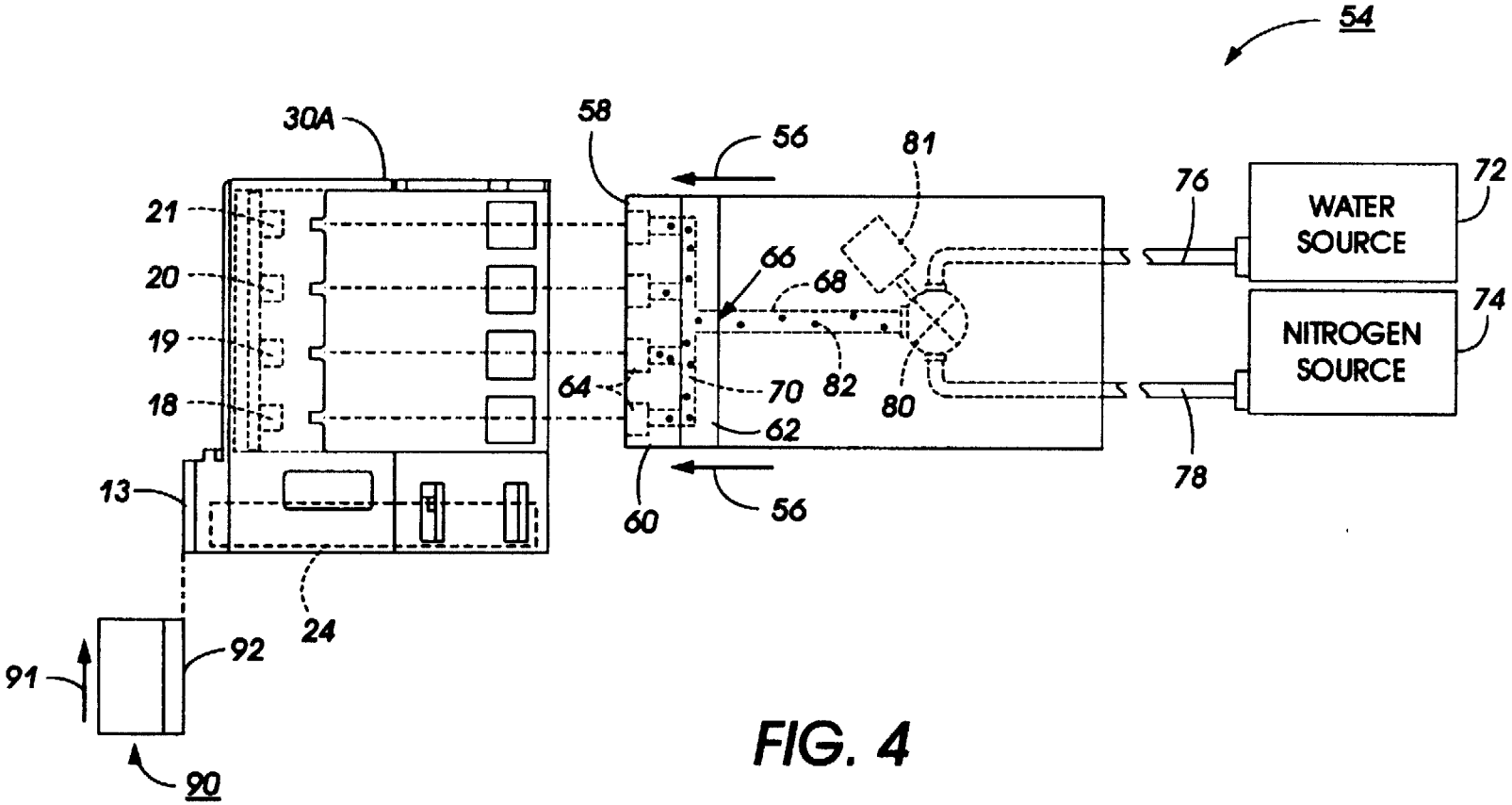
FIG. 4 is an enlarged view of the liquid cleaning assembly section of FIG. 2.

Referring to FIGS. 2, 3 and 4, automatic cleaning fixture 40 comprises a table 42 having a raised platform 44 with three datum points 46. Printhead housing assembly 30A is tilted and positioned so that the heat sink holes 26 are seated over datum points 46. An automated "CLEAN" mode is enabled at this point. Clamp 48 moves downward to press against housing side wall 36 with about four pounds of force clamping the housing in place. A vacuum cap assembly 50 is moved in the direction of arrow 52 until a gasket cap 53 is sealingly engaged over nozzle plate 13 providing a suitable vacuum force at each nozzle. Assembly 50 is of the type used to prime a printhead in a maintenance station and is disclosed in detail in, for example, U.S. Pat. No. 5,257, 044, whose contents are hereby incorporated by reference.

Continuing with the automated cleaning operation, liquid cleaning assembly 54 is moved in the direction of arrow 56 until a manifold interface member 58 is sealingly seated over ink pipes 18–21 of manifold 22. Member 58 comprises a silicone rubber gasket element 60 bonded to a liquid supply slotted plate 62. Element 60 has four holes 64 formed with a diameter slightly larger than the diameter of ink pipes 18–21. Plate 62 has an entrance port 66 connected to tube 68. Port 66 is connected to a slot 70 which communicates with holes 64. Assembly 54 further includes a source 72 of cleaning liquid (deionized water in the preferred embodiment), a source 74 of a gas, nitrogen in the preferred embodiment, and tubes 76, 78 which convey the water and nitrogen respectively to toggle valve 80 operated by solenoid 81. In the preferred embodiment, tubes 68, 76, 78 are ¼" polyurethane; nitrogen supply pressure is regulated at between 7 and 15 psi, and the vacuum pressure at vacuum cap assembly 50 is set at between 4" and 15" mercury. The cleaning liquid is deionized water with 0.05% Dowicil 200 biocide.

The automated clean operation begins with energization of an appropriate "start clean" switch following seating of the printhead housing assembly 30A. Clamp 48 moves downward to clamp the housing assembly into place. Vacuum assembly 50 moves in the direction of arrow 52 until gasket cap 53 is sealingly engaged over the nozzle plate 13, and the vacuum is applied. Cleaning assembly 54 moves in the direction of arrow 56 until manifold interface member 58 is connected to manifold 22; e.g. when holes 64 of silicon element 60 slide over and seat on ink pipes 18–21.

The water and nitrogen sources 72, 74 are activated and ink begins to be withdrawn from the printhead nozzles due to the vacuum pressure exerted by vacuum assembly 50. The ink, and later the cleaning fluid, is deposited in a waste container (not shown but part of assembly 50). Solenoid 81 is energized so as to toggle valve 80 at 500 millisecond intervals (50% duty cycle) for 6 seconds. The cleaning mixture flowing through tube 68 comprises the deionized water carrying nitrogen bubbles 82. The cleaning mixture enters plate 62 through port 66, flows along slot 70, through holes 64, ink pipes 18–21, and along internal printhead channel paths.

The cleaning mixture, and especially the presence of the nitrogen bubbles 82, provides a thorough cleaning of the manifold and the interior channels of the printhead, flushing out any residual ink through the nozzles. To ensure a complete cleaning, a second clean cycle is activated which passes nitrogen only through valve 80 for approximately 6 seconds; a 50% duty cycle is activated for another 6 seconds, and nitrogen only is passed through for 10 seconds. Towards the end of the second clean cycle, the water and nitrogen source are turned off and the cycle ends when all of the liquid mixture has been expelled out of the printhead. The liquid cleaning assembly 54, vacuum cap assembly 50 and clamp 48 are withdrawn, and housing 30 is removed and oven dried. In a preferred embodiment, oven drying is at 100° C. for 40–60 minutes.

Following the above-described cleaning cycle, a small amount of residual ink may remain on the printhead nozzle face 13. As an option, and as shown in FIG. 4, a non-contact wiper head 90 may be added to the automated fixture 40. Assembly 90 is positioned beneath clamped printhead housing assembly 30 and, when activated at the end of the clean cycles, moves upward in the direction of arrow 91 and presents a vacuum head 92 in close proximity (0.005" optimum) to the nozzle face. A vacuum of 27" mercury is applied to the head by conventional means not shown, and any residual ink on the nozzle face is drawn away and into the vacuum head in a waste container contained therein. The assembly is then lowered to its initial position.

To summarize the cleaning operation, a printhead housing is clamped into a cleaning position and a vacuum applied to the nozzle face. A cleaning liquid/gas mixture is forced through the printhead assembly manifold, along internal ink paths and through the printhead nozzles. The liquid/gas mixture provides enhanced cleaning of the printhead. It is believed the gas (nitrogen) bubbles provide a superior removal of residual ink and particulate matter.

While the invention was described in the context of cleaning a color printhead assembly with four separate ink cartridges and a single segmented printhead, it is understood that the invention is applicable to other types of printhead cartridge assemblies. For example, the color printhead assembly could include four ink cartridges, each with its associated individual printheads as disclosed, for example, in U.S. Pat. No. 4,571,599. As another example, the cleaning method can be used to clean full width ink jet printheads of the type disclosed, for example, in U.S. Pat. No. 5,160,945. As a still further example, the cleaning method can be used to clean a single color printhead with an associated cartridge as disclosed, for example, in U.S. Pat. No. 5,289,212. For these, and other printhead constructions, the automatic cleaning fixture, and especially the manifold interface member, is modified so as to introduce the cleaning mixture into the specific manifold design of the printhead to be cleaned. One skilled in the art can modify the interface member so as to introduce the cleaning fixture into the printhead interior.

Also, while nitrogen has been used as the preferred gas to be combined into the cleaning fluid mixture, other inert noble gases can be used such as argon, helium, and carbon dioxide.

While the embodiment disclosed herein is preferred, it will be appreciated from this teaching that various alternative, modifications, variations or improvements therein may be made by those skilled in the art, which are intended to be encompassed by the following claims:

We claim:

1. A method for cleaning the interior ink channels and nozzles of an ink jet printhead, including the steps of:

applying a vacuum to the printhead nozzles forming a mixture comprising a cleaning liquid and sure nitrogen bubbles and flushing the interior ink channels and nozzles of said printhead with said mixture.

2. The method of claim 1 including the further step of forming the mixture by alternately passing the cleaning liquid and pure nitrogen from separate supply sources through a two-way valve connected to the printhead.

3. The method of claim 1 including the further step of moving a vacuum wiping head across the printhead nozzles in a non-contact wiping mode to residual ink.

4. The method of claim 1 including the further step of drying the printhead following the flushing step.

5. A method for cleansing an ink jet printhead assembly, which includes an ink manifold fluidly connected to a printhead, of residual ink in a manifold, and internal channels and nozzles of the printhead including the steps of:

placing the printhead assembly in a fixed cleaning position, moving a vacuum cap assembly into sealing position across the printhead nozzles, applying a vacuum to create a suction force at the nozzles, moving a liquid cleaning assembly into sealing contact with the manifold so as to establish fluid communication between a cleaning fluid mixture of water and sure nitrogen formed within the cleaning assembly and the manifold, and circulating the cleaning mixture which includes pure nitrogen bubbles through said manifold and internal channels and nozzles of said printhead to completely flush out residual ink and particulate matter.

6. The method of claim 5 including the further step of forming the mixture by alternately passing nitrogen and water through a toggle valve.

7. An automated cleaning fixture for cleaning the ink paths associated with an ink jet printhead including printhead nozzles, ink channels and passageways through a manifold connecting the printhead to an ink supply, the fixture including:

means for maintaining the printhead in a fixed position, means for moving a gasket cap portion of a vacuum cap assembly into sealing engagement with the printhead nozzles of said printhead, and means for moving a liquid cleaning assembly including a solenoid-operated valve into communication with the manifold of said printhead to establish a passageway for circulating a mixture comprising water and pure nitrogen bubbles from said cleaning assembly through said manifold, ink channels and nozzles into a waste repository whereby passage of said mixture through the printhead removes residual ink and particulate matter from the printhead.

8. The fixture of claim 7 wherein the solenoid-operated valve forms the cleaning mixture by alternately allowing water and a flow of nitrogen into a tube connected between the manifold of said printhead and an outlet of the valve.

Cancel claim 9.

9. The fixture of claim 7 wherein the nitrogen Is supplied from a pressurized nitrogen source and the water is deionized water supplied from a separate water source.

* * * * *